US006596684B2

(12) United States Patent
Astley et al.

(10) Patent No.: US 6,596,684 B2
(45) Date of Patent: Jul. 22, 2003

(54) GRANULAR DETERGENT COMPONENT AND PROCESS FOR ITS PREPARATION

(75) Inventors: Martin Peter Astley, Wirral (GB); William Derek Emery, Wirral (GB)

(73) Assignee: Unilever Home & Personal Care USA divison of Conopco, Inc., Greenwich, CT (US)

( * ) Notice: Subject to any disclaimer, the term of this patent is extended or adjusted under 35 U.S.C. 154(b) by 104 days.

(21) Appl. No.: 09/837,113

(22) Filed: Apr. 18, 2001

(65) Prior Publication Data

US 2002/0039987 A1 Apr. 4, 2002

(30) Foreign Application Priority Data

Apr. 20, 2000 (GB) ..... 0009877

(51) Int. Cl.[7] ..... C11D 11/00

(52) U.S. Cl. ..... 510/444; 510/441; 510/504; 510/507; 510/509; 23/313 FB

(58) Field of Search ..... 510/444, 441, 510/276, 509, 504, 507; 23/313 FB

(56) References Cited

U.S. PATENT DOCUMENTS

| | | | | | |
|---|---|---|---|---|---|
| 4,101,456 | A | | 7/1978 | Renaud et al. | 252/551 |
| 4,427,417 | A | * | 1/1984 | Porasik | 23/313 FB |
| 4,510,073 | A | | 4/1985 | Hara et al. | 252/383 |
| 5,516,447 | A | * | 5/1996 | Bauer et al. | 510/535 |
| 5,536,432 | A | * | 7/1996 | Cicciari et al. | 510/377 |
| 5,739,097 | A | * | 4/1998 | Bauer et al. | 510/446 |
| 5,962,397 | A | * | 10/1999 | Ridyard et al. | 510/443 |
| 6,025,314 | A | | 2/2000 | Nitsch et al. | 510/221 |
| 6,056,905 | A | * | 5/2000 | Akkermans et al. | 264/117 |
| 6,103,685 | A | | 8/2000 | Hall | 510/475 |

FOREIGN PATENT DOCUMENTS

| | | |
|---|---|---|
| DE | 26 16 404 | 10/1976 |
| EP | 167 382 | 1/1986 |
| EP | 342 997 | 11/1989 |
| EP | 462 806 | 12/1991 |
| EP | 467 472 | 1/1992 |
| EP | 753 571 | 1/1997 |
| EP | 863 199 | 9/1998 |
| GB | 2 323 385 | 9/1998 |
| JP | 07/316 590 | 12/1995 |
| WO | 96/17042 | 6/1996 |
| WO | 97/09408 | 3/1997 |
| WO | 97/42281 | 11/1997 |
| WO | 98/53037 | 11/1998 |
| WO | 98/58046 | 12/1998 |
| WO | 00/44874 | 8/2000 |

OTHER PUBLICATIONS

Derwent Abstract of JP 04 153300—published May 26, 1992.

Derwent Abstract of DD a 296 307—published Nov. 28, 1991.

Derwent Abstract of JP 62 018500—published Jan. 27, 1987.

J. Penfold et al., Langmuir 1995, *Solution and Adsorption Behavior of the Mixed Surfactant System Sodium Dodecyl Sulfate/n–Hexaethylene Glycol Monododecyl Ether,* 11 2496–2503.

J. Penfold et al., Colloids and Surfaces A, *The Composition Of Mixed Surfactants and Cationic Polymer/Surfactant Mixtures Adsorbed At The Air–Water Interface,* 1997, 128, 107–117.

A. Creeth et al., J. Chem. Soc. Faraday Trans., *Composition of Mixed Surfactant–polymer Layers Adsorbed At the Air/Water Interface As Determined By Specular Neutron Reflection,* 92, 4, 589–594.

L. Yingjie et al., Langmuir 1995, *Complex Formation Between Polyelectrolyte And Oppositely Charged Mixed Micelles: Soluble Complexes vs Coacervation,* 11, 2486–2492.

* cited by examiner

*Primary Examiner*—Lorna M. Douyon
(74) *Attorney, Agent, or Firm*—Rimma Mitelman

(57) ABSTRACT

A granular detergent component comprising a high level of surfactant, for example, cationic surfactant, and an inorganic carrier material is prepared by a process involving spraying an aqueous solution of the surfactant onto moving granules of the inorganic carrier material in the presence of a drying gas, preferably air, at a temperature within the range of from 65 to 200° C. The process is preferably carried out in a fluidised bed. Preferred inorganic carrier materials are sodium carbonate and zeolite MAP.

31 Claims, No Drawings

GRANULAR DETERGENT COMPONENT AND PROCESS FOR ITS PREPARATION

TECHNICAL FIELD

The present invention relates to a granular detergent component suitable for incorporation into particulate laundry detergent compositions, and a novel process for its preparation. The granular detergent component contains a cationic, zwitterionic or amphoteric surfactant.

BACKGROUND

Cationic, amphoteric and zwitterionic surfactants are useful ingredients in laundry detergent compositions, generally used in relatively minor amounts as co-surfactants to supplement non-soap anionic surfactants and, in some cases, nonionic surfactants.

These materials are commercially available as aqueous solutions of relatively low concentration, generally below 50 wt %, for example, 30 to 40 wt %. For some materials, for example, water-soluble quaternary ammonium cationic surfactants having a single long hydrocarbon chain, mobile solutions of higher concentration are not possible because gelling occurs.

While these solutions may be suitable for inclusion in liquid detergent compositions, or for incorporation in detergent powders via traditional slurry-making and spray-drying processes, the large amount of associated water can pose problems in preparing granular detergent compositions or components by non-spray-drying (mixing and granulation) processes. For incorporation into "compact" or "concentrated" laundry powders, a granule containing a relatively high surfactant loading is required.

PRIOR ART

WO 96 17042A (Procter & Gamble) discloses detergent granules containing a water-soluble cationic surfactant and an inorganic carrier, the granules also containing an anionic surfactant in a weight ratio to the cationic surfactant of less than 1:1, and preferably less than 0.5:1. The inorganic carrier material is zeolite. The granules are prepared by evaporating and concentrating a solution of the cationic and anionic surfactants to a concentration above 50 wt %, and then granulating with the carrier material. The presence of the anionic surfactant prevents gelling during the concentration step.

WO 98/53037A (Procter & Gamble) discloses a process for the preparation of cationic surfactant granules, in which a aqueous solution or dispersion of cationic surfactant, optionally plus sodium silicate and/or filler, is dried in the presence of a drying gas, preferably air, at a temperature of less than 250° C. The preferred drying method is co-current spray-drying.

The present inventors have now discovered that granules containing more than 20 wt % of cationic, amphoteric or zwitterionic surfactant may be obtained in a non-spray-drying process, without the need for elevated temperatures and without the need for anionic surfactant.

DEFINITION OF THE INVENTION

The invention accordingly provides a process for the preparation of a granular detergent component comprising (a) at least 20 wt % of a surfactant selected from cationic surfactants, zwitterionic surfactants, amphoteric surfactants and mixtures thereof, (b) an inorganic carrier material, which process comprises spraying an aqueous solution of the surfactant (a) onto moving granules of the inorganic carrier material (b) in the presence of a drying gas at a temperature within the range of from 65 to 200° C., preferably from 80 to 200° C., and more preferably from 100 to 150° C.

In a second aspect, the present invention provides a granular detergent component comprising (a) at least 20 wt % of a surfactant selected from cationic surfactants, zwitterionic surfactants, amphoteric surfactants and mixtures thereof, (b) an inorganic carrier material, the granular detergent component being free of sodium sulphate.

In a third aspect, the present invention provides a particulate laundry detergent composition comprising in total from 5 to 60 wt % of one or more organic detergent surfactants, from 10 to 80 wt % of one or more detergency builders and optionally other detergent ingredients, which composition includes a granular detergent component as defined above.

DETAILED DESCRIPTION OF THE INVENTION

The Cationic, Amphoteric or Zwitterionic Surfactant

The invention is applicable to any cationic, amphoteric or zwitterionic surfactant which is supplied as a relatively dilute (for example, less than 50 wt %) aqueous solution. It is especially applicable to such surfactants which are sensitive to heat and liable to degradation or decomposition at temperatures above 200° C., or even above 150° C.

Preferred water-soluble cationic surfactants are quaternary ammonium salts of the general formula I $$R_1R_2R_3R_4N^+X^- \quad (I)$$

wherein $R_1$ is a relatively long ($C_8$–$C_{18}$) hydrocarbon chain, typically an alkyl, hydroxyalkyl or ethoxylated alkyl group, optionally interrupted with a heteroatom or an ester or amide group; each of $R_2$, $R_3$ and $R_4$ (which may be the same or different) is a short-chain ($C_1$–$C_3$) alkyl or substituted alkyl group; and X is a solubilising anion, for example a chloride, bromide or methosulphate ion.

In a preferred class of compounds, $R_1$ is a $C_8$–$C_{18}$ alkyl group, more preferably a $C_8$–$C_{10}$ or $C_{12}$–$C_{14}$ alkyl group, $R_2$ is a methyl group, and $R_3$ and $R_4$, which may be the same or different, are methyl or hydroxyethyl groups.

In an especially preferred compound, $R_1$ is a $C_{12}$–$C_{14}$ alkyl group, $R_2$ and $R_3$ are methyl groups, $R_4$ is a 2-hydroxyethyl group, and $X^-$ is a chloride ion. This material is available commercially as Praepagen (Trade Mark) HY from Clariant GmbH, in the form of a 40 wt % aqueous solution.

Other classes of cationic surfactant include cationic esters (for example, choline esters).

Preferred zwitterionic surfactants include betaines of the formula II

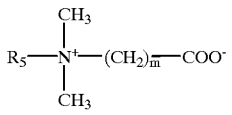

(II)

wherein $R_5$ is a hydrocarbon chain containing 8 to 20 carbon atoms, optionally interrupted by an amide group, and m is an integer from 1 to 4.

Especially preferred zwitterionic surfactants are betaines of the formula IIa

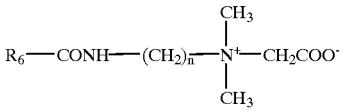

(IIa)

wherein $R_6$ is a $C_8$–$C_{18}$ alkyl group, and n is an integer of from 2 to 4.

An especially preferred material is cocoamidopropyl betaine (CAPB), in which $R_6$ is $C_{12}$–$C_{14}$ alkyl and m is 3.

Preferred amphoteric surfactants include alkyl amine oxides of the general formula III $$R_7R_8R_9N \rightarrow O \quad \text{(III)}$$

wherein $R_7$ is typically a $C_8$–$C_{18}$ alkyl group, for example, $C_{12}$–$C_{14}$ alkyl, and $R_8$ and $R_9$, which may be the same or different, are $C_1$–$C_3$ alkyl or hydroxyalkyl groups, for example, methyl groups. The most preferred amine oxide is coco dimethylamine oxide, in which $R_7$ is $C_{12}$–$C_{14}$ alkyl and $R_8$ and $R_9$ are methyl groups.

The Inorganic Carrier Material

The granular detergent component of the invention contains, as an essential ingredient, an inorganic carrier material.

According to a first preferred embodiment of the invention, the inorganic carrier material consists to an extent of at least 80 wt % of water-soluble material. The use of a predominantly water soluble carrier material is believed to be particularly advantageous in products intended for laundering by hand.

Preferred water-soluble carrier materials are sodium carbonate, sodium tripolyphosphate and mixtures thereof. Sodium carbonate is especially preferred.

In this embodiment of the invention, up to 20 wt % of the inorganic carrier material may be constituted by water-insoluble material. Preferred water-insoluble carrier materials are aluminosilicates, particularly crystalline alkali metal aluminosilicates (zeolites), silicas, calcites and clays.

Thus, advantageously the inorganic carrier material comprises from 80 to 100 wt % of sodium carbonate, and optionally up to 20 wt % of water-insoluble carrier material selected from crystalline alkali metal aluminosilicates (zeolites), silicas, calcites and clays.

In a second preferred embodiment of the invention, the inorganic carrier consists at least partially of water-insoluble material. Preferably the inorganic carrier material comprises from 80 to 100 wt % of water insoluble material. Advantageously, the inorganic carrier material may comprise from 20 to 100 wt % of crystalline alkali metal aluminosilicate. Most preferably, the inorganic carrier material comprises from 80 to 100 wt % of crystalline alkali metal aluminosilicate.

Preferred water-insoluble carrier materials are aluminosilicates, silicas, clays, calcite and mixtures thereof. Crystalline alkali metal aluminosilicate (zeolite) is preferred. An especially preferred zeolite material is zeolite MAP, commercially available from Crosfield Chemicals as Doucil (Trade Mark) A24. An alternative zeolite material is zeolite A powder, available, for example, as Wessalith (Trade Mark) P from Degussa AG.

The choice of carrier material may be dictated by the detergent formulation into which the granular component is to be incorporated. The process of the invention is sufficiently flexible to accommodate any inorganic granular material having sufficient carrying capacity.

The Process

As previously indicated, the granular detergent component is prepared by a non-spray-drying process in which an aqueous solution of the surfactant (a) is sprayed onto moving granules of the inorganic carrier material (b) in the presence of a drying gas at a temperature of from 65 to 200° C., preferably 80 to 200° C., more preferably from 100 to 150° C.

In the process of the invention, as the surfactant solution contacts the carrier granules, water is simultaneously rapidly driven off. The formation of gel phases of intermediate concentration is thus avoided and it is unnecessary to include special ingredients such as anionic surfactants in order to avoid gelling. This is achieved without the necessity for high temperatures, for example above 250° C., which could cause degradation of the surfactant (a). The process of the invention thus enables the large amount of water associated with the surfactant (a) in the starting solution to be driven off, as the solution encounters the granules of carrier material, without the formation of unprocessable gel phases, and without the use of high temperatures which could cause decomposition or degradation of the surfactant (a).

The maximum temperature during the process is no higher than 200° C. and is preferably no higher than 150° C.

The starting surfactant solution preferably has a concentration of less than 50 wt %, and preferably within the range of from 30 to 45 wt %. The upper limit will depend on the particular surfactant and the concentration at which the solution becomes too viscous for spraying. The lower limit is a matter of practicality because if the amount of water is too high the process will be too slow and consume too much energy to be economic.

According to a preferred embodiment of the invention, the process is carried out in a fluidised bed. This preferred process of the invention comprises the steps of:

(i) fluidising granules of the inorganic carrier material (b) using a gas having a temperature within the range of from 100 to 150° C., (ii) spraying an aqueous solution of the surfactant (a) onto the mass of fluidised granules, (iii) cooling the resulting granular detergent component by mixing in the presence of a gas having a temperature not exceeding 50° C.

Preferably, the drying and cooling gases used in steps (i) and (iii) are air. The preferred cooling gas is air at ambient temperature.

The aqueous solution of the surfactant (a) is advantageously preheated to a temperature within the range of from 50 to 70° C.

In this embodiment, granules of carrier material are fluidised using a drying gas, preferably air, for example, at 100 to 150° C. Surfactant solution, preferably preheated to 50 to 70° C., is sprayed onto the mass of fluidised granules. After sufficient surfactant solution has been added to attain the desired concentration in the final product, for example, 20 to 40 wt %, the granules are cooled.

The cooling step (iii) is preferably carried out in a fluidised bed. The heating (spraying-on) and cooling stages of the process may be carried out within a single fluidised bed, either operating in alternate heating and cooling cycles, or divided into two sections, one for the heating stage and the other for the cooling stage. Alternatively, two fluid beds in series may be used.

The use of a fluidised bed for heating (spraying-on) step solves the problem of driving off the water from the surfactant solution sufficiently rapidly to avoid the formation of higher-concentration gel phases, while avoiding temperatures that would cause decomposition or degradation of the surfactant.

According to an alternative embodiment of the invention, the process may be carried out in a flash dryer, either under vacuum or at atmospheric pressure.

The granules may subsequently be layered with a finely divided flow aid in any suitable mixer. Preferred flow aids are selected from zeolites and amorphous aluminosilicates.

In a preferred embodiment the process is carried out as a batch process.

The process may advantageously include a preliminary step wherein a partial quantity of the surfactant is added to the inorganic carrier material prior to the main process step or steps.

This may be of particular value when the carrier material is zeolite, more particularly zeolite MAP which typically has an average primary particle size of 0.1–5 micrometres.

The preliminary step is suitably carried out in a mixer/granulator. Alternatively it may be carried out in a fluidised bed having a substantially reduced gas flow rate than used in the main process.

Including the preliminary step improves the process by allowing a higher initial gas velocity in the main fluidised bed process due to the increased size of the constituent particles of the inorganic carrier material, thus reducing batch times, or increasing throughput in a continuous process. The preliminary step may also be beneficial in enabling greater levels of the surfactant to be added to the inorganic carrier material, whether or not the carrier material has a small particle size.

The Granular Detergent Component

The granular detergent component of the invention contains, as essential ingredients, the surfactant (a) and the inorganic carrier material (b).

The component contains at least 20 wt % of the surfactant (a), and preferably contains at least 30 wt %. Typically the component will contain from 20 to 40 wt % of the surfactant (a), more preferably from 25 to 35 wt %.

The inorganic carrier material is preferably present in a total amount of from 50 to 80 wt %, more preferably from 60 to 75 wt %.

Advantageously, the granular component may have an outer layer or coating of finely divided water-insoluble flow aid, preferably selected from zeolites and amorphous aluminosilicates. The flow aid is preferably present in an amount of from 1 to 5 wt %, more preferably from 1 to 3 wt %. The most preferred flow aid is zeolite powder.

In the first preferred embodiment of the invention, the granular component may suitably comprise:

from 20 to 40 wt %, preferably from 25 to 35 wt %, of the surfactant (a), from 60 to 75 wt %, preferably from 65 to 70 wt %, of sodium carbonate, from 1 to 5 wt %, preferably from 1 to 3 wt %, of zeolite, the zeolite being present as an outer layer or coating.

In the second preferred embodiment of the invention, the granular component may suitably comprise:

from 20 to 40 wt %, preferably from 25 to 35 wt %, of the surfactant (a), from 60 to 80 wt %, preferably from 65 to 75 wt %, of zeolite. (zeolite may in part be present as coating)

If desired the granular component may contain a minor amount of sodium silicate, but preferably the amount of silicate present is less than 5 wt %.

The granular component is preferably free of sodium sulphate which, although highly water-soluble, has insufficient carrying capacity to be useful.

Minor amounts of other materials may be present if desired, but the granular component of the invention preferably does not contain anionic surfactants.

Detergent Compositions

The granular detergent component of the invention provides a convenient route for the incorporation into particulate detergent compositions of surfactants which are available only as dilute aqueous solutions. The granules may simply be dry-mixed with other particulate ingredients or components to form the final detergent composition.

Accordingly, a further aspect of the invention provides a particulate laundry detergent composition comprising in total from 5 to 60 wt % of one or more organic detergent surfactants, from 10 to 80 wt % of one or more detergency builders and optionally other detergent ingredients, which composition includes a granular detergent component as defined above.

Detergent compositions of the invention contain detergent-active compounds and detergency builders, and may optionally contain bleaching components and other active ingredients to enhance performance and properties.

Detergent-active compounds (surfactants) may be chosen from soap and non-soap anionic, cationic, nonionic, amphoteric and zwitterionic detergent-active compounds, and mixtures thereof. Many suitable detergent-active compounds are available and are fully described in the literature, for example, in "Surface-Active Agents and Detergents", Volumes I and II, by Schwartz, Perry and Berch. The preferred detergent-active compounds that can be used are soaps and synthetic non-soap anionic and nonionic compounds. The total amount of surfactant present is suitably within the range of from 5 to 40 wt %.

Anionic surfactants are well-known to those skilled in the art. Examples include alkylbenzene sulphonates, particularly linear alkylbenzene sulphonates having an alkyl chain length of $C_8$–$C_{15}$; primary and secondary alkylsulphates, particularly $C_8$–$C_{20}$ primary alkyl sulphates; alkyl ether sulphates; olefin sulphonates; alkyl xylene sulphonates; dialkyl sulphosuccinates; and fatty acid ester sulphonates. Sodium salts are generally preferred.

Nonionic surfactants that may be used include the primary and secondary alcohol ethoxylates, especially the $C_8$–$C_{20}$ aliphatic alcohols ethoxylated with an average of from 1 to 20 moles of ethylene oxide per mole of alcohol, and more especially the $C_{10}$–$C_{15}$ primary and secondary aliphatic alcohols ethoxylated with an average of from 1 to 10 moles of ethylene oxide per mole of alcohol. Non-ethoxylated nonionic surfactants include alkylpolyglycosides, glycerol monoethers, and polyhydroxyamides (glucamide).

The cationic, amphoteric and zwitterionic surfactants with which the present invention is concerned also form part of the surfactant system. They will generally be present in combination with anionic surfactants, the weight ratio of anionic surfactant to cationic, amphoteric or zwitterionic surfactant being at least 1:1.

These lists of surfactants is not intended to be exhaustive and the use of any surfactant suitable for incorporation in particulate laundry detergent compositions falls within the scope of the present invention.

The detergent compositions of the invention also contain one or more detergency builders. The total amount of detergency builder in the compositions will suitably range from 5 to 80 wt %, preferably from 10 to 60 wt %.

Preferred builders are alkali metal aluminosilicates, more especially crystalline alkali metal aluminosilicates (zeolites), preferably in sodium salt form.

Zeolite builders may suitably be present in a total amount of from 5 to 60 wt %, preferably from 10 to 50 wt %.

The zeolites may be supplemented by other inorganic builders, for example, amorphous aluminosilicates, or layered silicates such as SKS-6 ex Clariant.

The zeolites may be supplemented by organic builders, for example, polycarboxylate polymers such as polyacrylates and acrylic/maleic copolymers; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates, alkyl- and alkenylmalonates and succinates; and sulphonated fatty acid salts.

Alternatively, the compositions of the invention may contain phosphate builders, for example, sodium tripolyphosphate.

These lists of builders are not intended to be exhaustive.

Especially preferred organic builders are citrates, suitably used in amounts of from 1 to 30 wt %, preferably from 2 to 15 wt %; and acrylic polymers, more especially acrylic/maleic copolymers, suitably used in amounts of from 0.5 to 15 wt %, preferably from 1 to 10 wt %. Builders, both inorganic and organic, are preferably present in alkali metal salt, especially sodium salt, form.

Detergent compositions according to the invention may also suitably contain a bleach system. Preferably this will include a peroxy bleach compound, for example, an inorganic persalt or an organic peroxyacid, capable of yielding hydrogen peroxide in aqueous solution.

Preferred inorganic persalts are sodium perborate monohydrate and tetrahydrate, and sodium percarbonate, the latter being especially preferred. The sodium percarbonate may have a protective coating against destabilisation by moisture. The peroxy bleach compound is suitably present in an amount of from 5 to 35 wt %, preferably from 10 to 25 wt %. The peroxy bleach compound may be used in conjunction with a bleach activator (bleach precursor) to improve bleaching action at low wash temperatures. The bleach precursor is suitably present in an amount of from 1 to 8 wt %, preferably from 2 to 5 wt %. Preferred bleach precursors are peroxycarboxylic acid precursors, more especially peracetic acid precursors and peroxybenzoic acid precursors; and peroxycarbonic acid precursors. An especially preferred bleach precursor suitable for use in the present invention is N,N,N',N'-tetracetyl ethylenediamine (TAED).

A bleach stabiliser (heavy metal sequestrant) may also be present. Suitable bleach stabilisers include ethylenediamine tetraacetate (EDTA), diethylenetriamine pentaacetate (DTPA), ethylenediamine disuccinate (EDDS), and the polyphosphonates such as the Dequests (Trade Mark), ethylenediamine tetramethylene phosphonate (EDTMP) and diethylenetriamine pentamethylene phosphate (DETPMP).

The compositions of the invention may contain alkali metal, preferably sodium, carbonate, in order to increase detergency and ease processing. Sodium carbonate may suitably be present in amounts ranging from 1 to 60 wt %, preferably from 2 to 40 wt %.

Sodium silicate may also be present, suitably in an amount of from 0.1 to 5 wt %.

Powder flow may be improved by the incorporation of a small amount of a powder structurant. Examples of powder structurants, some of which may play also other roles in the formulation, include, for example, fatty acids (or fatty acid soaps), sugars, acrylate or acrylate/maleate polymers, sodium silicate, and dicarboxylic acids (for example, Sokalan (Trade Mark) DCS ex BASF). One preferred powder structurant is fatty acid soap, suitably present in an amount of from 1 to 5 wt %.

Other materials that may be present in detergent compositions of the invention include antiredeposition agents such as cellulosic polymers; soil release agents; anti-dye-transfer agents; fluorescers; inorganic salts such as sodium sulphate; enzymes (proteases, lipases, amylases, cellulases); dyes; colored speckles; perfumes; and fabric conditioning compounds. This list is not intended to be exhaustive.

Detergent Composition Product Form and Preparation

The detergent compositions of the invention are in particulate form. Particulate detergent compositions comprise powders, and tablets of compacted powder. They may be prepared by any of the methods suitable for the preparation of such compositions.

Powders of low to moderate bulk density may be prepared by spray-drying a slurry, and optionally postdosing (dry-mixing) further ingredients. "Concentrated" or "compact" powders may be prepared by mixing and granulating processes, for example, using a high-speed mixer/granulator, or other non-tower processes.

EXAMPLES

The invention is illustrated in further detail by the following non-limiting Examples, in which parts and percentages are by weight unless otherwise stated.

The following parameters and test methods are used in the Examples.

Dynamic Flow Rate

Powder flow may be quantified by means of the dynamic flow rate (DFR), in ml/s, measured by means of the following procedure. The apparatus used consists of a cylindrical glass tube having an internal diameter of 35 mm and a length of 600 mm. The tube is securely clamped in a position such that its longitudinal axis is vertical. Its lower end is terminated by means of a smooth cone of polyvinyl chloride having an internal angle of 15° and a lower outlet orifice of diameter 22.5 mm. A first beam sensor is positioned 150 mm above the outlet, and a second beam sensor is positioned 250 mm above the first sensor.

To determine the dynamic flow rate of a powder sample, the outlet orifice is temporarily closed, for example, by covering with a piece of card, and powder is poured through a funnel into the top of the cylinder until the powder level is about 10 cm higher than the upper sensor; a spacer between the funnel and the tube ensures that filling is uniform. The outlet is then opened and the time $\underline{t}$ (seconds) taken for the powder level to fall from the upper sensor to the lower sensor is measured electronically. The measurement is normally repeated two or three times and an average value taken. If $\underline{V}$ is the volume (ml) of the tube between the upper and lower sensors, the dynamic flow rate DFR (ml/s) is given by the following equation:

$$DFR = \frac{V}{t} \text{ ml/s}$$

The averaging and calculation are carried out electronically and a direct read-out of the DFR value obtained.

Compressibility

The method of measuring compressibility used in the present invention is as follows.

The experiment is carried out at 20–25° C. and a relative humidity of about 40%. These values represent typical ambient conditions in a northern European indoor laboratory environment. The exact relative humidity at which the measurement is carried out is not critical, provided that it is not so high that the samples take up moisture.

The apparatus comprises a perspex cylinder with an internal diameter of 54 mm and a height of 170 mm. The side of the cylinder is graduated in millimeters. A piston is provided which fits the internal diameter of the perspex cylinder.

The top of the piston has means to support a weight, whereby pressure can be applied to detergent powder contained in the perspex cylinder. The combined mass of the piston and the weight is 25 kg.

To measure the compressibility of a sample, the perspex cylinder is filled with particulate detergent composition (hereinafter "powder"). The top of the layer of powder is levelled by removing superfluous powder with a straightedge. Thus, a standard volume of powder is tested. The initial volume is measured by means of the scale on the side of the cylinder. The piston and weight are then lowered onto the surface of the powder and are allowed to rest freely on the powder for 60 seconds. The volume of the powder after 60 seconds is measured by means of the scale on the side of the cylinder.

The volume reduction is used to calculate the compressibility using the following equation:

$$\underset{(\text{in}\%)}{\text{Compressibility}} = \frac{(\text{initial volume} - \text{final volume})}{\text{initial volume}} \times 100$$

Components having a compressibility of 17% or more can lead to stickiness or storage problems if present at too high a level.

Example 1

A granular detergent component was prepared to the following nominal formulation:

| | Weight % |
|---|---|
| Cationic surfactant (as anhydrous material) | 30.00 |
| Sodium carbonate | 68.00 |
| Zeolite | 2.00 |

The cationic surfactant was $C_{12}$–$C_{14}$ alkyl dimethyl hydroxyethyl ammonium chloride, Praepagen HY (Trade Mark), supplied by Clariant GmbH as a 40 wt % aqueous solution.

The granules were prepared in an approximately 10 kg batch process using a Vomatec (Trade Mark) fluidised bed. Starting materials used were as follows:

| | kg |
|---|---|
| Cationic surfactant (40% solution) | 11.4 |
| Anhydrous sodium carbonate (light soda ash) | 10.0 |
| Zeolite MAP powder | 0.4 |

The light soda ash, which had a starting average particle size of 90 micrometres, was fluidised using air at 120° C., and the cationic surfactant solution, preheated to 60° C., was sprayed on. As the solution encountered the sodium carbonate particles, the water was rapidly driven off leaving the cationic surfactant deposited onto the sodium carbonate. Further deposition and evaporation took place, with some agglomeration, until the granules within the fluid bed contained about 30 wt % of cationic surfactant. The resulting granules were cooled using fluidising air at ambient temperature (20° C.), and zeolite was layered on.

The granules had the following properties:

| | |
|---|---|
| Measured cationic surfactant content (wt %) | 31.6 |
| Bulk density (g/l) | 588 |
| Dynamic flow rate (ml/s) | 134 |
| Compressibility (vol %) | 12.4 |
| Average particle size $d_{50}$ (micrometer) | 394 |
| Particles <180 micrometer (wt %) | 2.5 |
| Dissolution time $T_{90}$ (s) | 16 |
| Loss at 135° C. (wt %) | 1.6 |

Examples 2 TO 8

Example 1 was repeated using the solids mixes listed below to replace the 10 kg light soda ash used in Example 1.

| | Example | | | | | | |
|---|---|---|---|---|---|---|---|
| | 2 | 3 | 4 | 5 | 6 | 7 | 8 |
| Ingredient (kg) | | | | | | | |
| Light soda ash | 9 | 9 | 8 | 9 | 9 | 9 | 9 |
| Na alk. silicate | 1 | | | | | | |
| Calcite (Durcal 15) 15 μm | | 1 | 2 | | | | |
| Calcite (Durcal 40) 40 μm | | | | 1 | | | |
| Kaolin | | | | | 1 | | |
| Speswhite clay (kaolin) | | | | | | 1 | |
| STP | | | | | | | 1 |
| Zeolite MAP | 0.4 | 0.4 | 0.4 | 0.4 | 0.4 | 0.4 | 0.4 |
| Measured cationic surfactant content (wt %) | 29.2 | 31.0 | 30.9 | 29.4 | 29.3 | 26.2 | 23.8 |
| Bulk density g/l | 509 | 497 | 509 | 520 | 509 | 588 | 599 |
| DFR (ml/s) | 109 | 103 | 113 | 110 | 104 | 99 | 64 |

Example 9

Granules to the nominal composition given in Example 1 were prepared on a larger scale using a Niro fluid bed suitable for 100 kg batch operation. The cationic surfactant solution, preheated to 60° C., was sprayed onto 75 kg of light soda ash in a 0.5 $m^2$ bed with fluidisation by air at 130° C. After the required amount of cationic surfactant solution had been added, the granulated material was passed through the remainder of the fluid bed using air at ambient temperature (20°C.). The cooled granules were sieved and then layered with 2 wt % zeolite in a concrete mixer. The properties of the granules were as shown below.

| | |
|---|---|
| Measured cationic surfactant content (wt %) | ca. 30 |
| Bulk density (g/l) | 700 |
| Dynamic flow rate (ml/s) | 140 |
| Compressibility (vol %) | 10.0 |
| Average particle size $d_{50}$ (micrometer) | 500 |
| Particles <180 micrometer (wt %) | <5 |

-continued

| | |
|---|---|
| Dissolution time $T_{90}$ (s) | <20 |
| Loss at 135° C. (wt %) | 4.7 |

Example 10

A granular detergent component was prepared to the following nominal formulation:

| | Weight % |
|---|---|
| Cationic surfactant (as anhydrous material) | 34.00 |
| Zeolite MAP | 58.00 |
| Water | 8.00 |

The cationic surfactant and zeolite MAP were as used in Example 1.

The granules were prepared in an approximately 10 kg batch process using a Vomatec (Trade Mark) fluidised bed. Starting materials used were as follows:

| | kg |
|---|---|
| Cationic surfactant (40% solution) | 14.65 |
| Zeolite MAP | 10.0 |

The zeolite MAP, which had a starting average particle size of 1 micrometer, was fluidised using air at 120° C., and the cationic surfactant solution, preheated to 60° C., was sprayed on. As the solution encountered the zeolite particles, the water was rapidly driven off leaving the cationic surfactant deposited onto the zeolite. Further deposition and evaporation took place, with some agglomeration, until the granules within the fluid bed contained about 34 wt % of cationic surfactant. The resulting granules were cooled using fluidising air at ambient temperature (20° C.), and zeolite was layered on.

The granules had the following properties:

| | |
|---|---|
| Measured cationic surfactant content (wt %) | ca. 34 |
| Bulk density (g/l) | 578 |
| Dynamic flow rate (ml/s) | 137 |
| Compressibility (vol %) | 8.0 |
| Average particle size $d_{50}$ (micrometer) | 585 |
| Particles <180 micrometer (wt %) | <5 |
| Dissolution time $T_{90}$ (s) | 84 |

Example 11

Granules to the nominal composition given in Example 10 were prepared on a larger scale using a Hutlin fluid bed suitable for 500 kg batch operation. The cationic surfactant solution, preheated to 60° C., was sprayed onto 375 kg of light soda ash in a 1.5 $m^2$ bed with fluidisation by air at 130° C. After the required amount of cationic surfactant solution had been added, the granulated material was passed through the remainder of the fluid bed using air at ambient temperature (20°C.). The cooled granules were sieved and then layered with 2 wt % zeolite in a concrete mixer. The properties of the granules were as shown below.

| | |
|---|---|
| Measured cationic surfactant content (wt %) | ca. 34 |
| Bulk density (g/l) | 785 |
| Dynamic flow rate (ml/s) | 147 |
| Compressibility (vol %) | 4.0 |
| Average particle size $d_{50}$ (micrometer) | 537 |
| Particles <180 micrometer (wt %) | <5 |
| Dissolution time $T_{90}$ (s) | 100 |

We claim:

1. A process for the preparation of a granular detergent component comprising (a) at least 20 wt % of a surfactant selected from the group consisting of cationic surfactants, zwitterionic surfactants, amphoteric surfactants and mixtures thereof, (b) an inorganic carrier material, which process comprises spraying an aqueous solution of the surfactant (a) onto moving granules of the inorganic carrier material (b) in the presence of a drying gas at a temperature within the range of from 65 to 200 ° C., wherein the process includes a preliminary step wherein a partial quantity of the surfactant (a) is added to the inorganic carrier material prior to spraying the aqueous solution of the surfactant (a) onto moving granules of the inorganic carrier material (b) in the presence of a drying gas.

2. A process as claimed in claim 1, carried out at a temperature within the range of from 80 to 200° C.

3. A process as claimed in claim 2, carried out at a temperature within the range of from 100 to 150° C.

4. A process as claimed in claim 1, carried out in a fluidized bed.

5. A process as claimed in claim 1, carried out in a fluidized bed, which comprises the steps of (i) fluidizing granules of the inorganic carrier material (b) using a gas having a temperature within the range of from 100 to 150° C., (ii) spraying an aqueous solution of the surfactant (a) onto the mass of fluidized granules, (iii) cooling the resulting granular detergent component by mixing in the presence of a gas having a temperature not exceeding 50° C.

6. A process as claimed in claim 5, wherein the drying and cooling gases used in steps (i) and (iii) are air.

7. A process as claimed in claim 5, wherein the aqueous solution of the surfactant (a) is preheated to a temperature within the range of from 50 to 70° C.

8. A process as claimed in claim 5, wherein the cooling step (iii) is carried out in a fluidized bed.

9. A process as claimed in claim 1, wherein the aqueous solution of the surfactant (a) has a concentration of less than 50 wt %.

10. A process as claimed in claim 1, wherein the aqueous solution of the surfactant (a) has a concentration of from 30 to 45 wt %.

11. A process as claimed in claim 1, wherein the aqueous solution of the surfactant (a) is free of anionic surfactants.

12. A process as claimed in claim 1, wherein the surfactant (a) comprises a cationic surfactant which is a water-soluble quaternary ammonium salt of the general formula I $$R_1R_2R_3R_4N^+X^- \quad (I)$$

wherein $R_1$ is a $C_8$–$C_{18}$ hydrocarbon group, optionally interrupted with a heteroatom or an ester or amide group;

each of $R_2$, $R_3$ and $R_4$, which may be the same or different, is a $C_1$–$C_3$ alkyl or substituted alkyl group; and X is a solubilizing anion.

13. A process as claimed in claim 12, wherein in the compound of the formula I $R_1$ is a $C_8$–$C_{18}$ alkyl group, $R_2$ is a methyl group, and $R_3$ and $R_4$, which may be the same or different, are methyl or hydroxyethyl groups.

14. A process as claimed in claim 13, wherein in the compound of the formula I $R_1$ is a $C_8$–$C_{10}$ alkyl group.

15. A process as claimed in claim 13, wherein in the compound of the formula I $R_1$ is a $C_{12}$–$C_{14}$ alkyl group.

16. A process as claimed in claim 1, which further comprises the step of coating the granular detergent component with an outer layer of finely divided water-insoluble flow aid.

17. A process as claimed in claim 16, wherein the flow aid is selected from the group consisting of zeolites and amorphous aluminosilicates.

18. A process as claimed in claim 1, wherein the granular detergent component contains at least 25 wt % of the surfactant (a).

19. A process as claimed in claim 1, wherein the granular detergent component contains at least 30 wt % of the surfactant (a).

20. A process as claimed in claim 1, which is carried out as a batch process.

21. A process as claimed in claim 1 where the preliminary step is a pre-granulation step, carried out in a mixer/granulator.

22. A process as claimed in claim 1, wherein at least 80 wt % of the inorganic carrier material is water-soluble.

23. A process as claimed in claim 22, wherein the inorganic carrier material comprises from 80 to 100 wt % of a water-soluble material selected from the group consisting of sodium carbonate, sodium tripolyphosphate and mixtures thereof, and optionally up to 20 wt % of a water-insoluble material.

24. A process as claimed in claim 23, wherein the inorganic carrier material comprises from 80 to 100 wt % of sodium carbonate, and optionally up to 20 wt % of a water-insoluble inorganic carrier material selected from the group consisting of aluminosilicates, silicas, clays and calcite.

25. A process as claimed in claim 1, wherein the granular detergent component comprises from 20 to 40 wt % of the surfactant (a), and from 60 to 80 wt % of sodium carbonate.

26. A process as claimed in claim 1, wherein the inorganic carrier material comprises from 80 to 100 wt % of water-insoluble material.

27. A process as claimed in claim 1, wherein the inorganic carrier material comprises crystalline alkali metal aluminosilicate.

28. A process as claimed in claim 27, wherein the inorganic carrier material comprises from 20 to 100 wt % of crystalline alkali metal aluminosilicate.

29. A process as claimed in claim 27, wherein the inorganic carrier material comprises from 80 to 100 wt % of crystalline alkali metal aluminosilicate.

30. A process as claimed in claim 27, wherein the inorganic carrier material comprises a crystalline alkali metal aluminosilicate which is zeolite MAP.

31. A process as claimed in claim 27, which comprises from 20 to 40 wt % of the surfactant (a), and from 60 to 80 wt % of crystalline alkali metal aluminosilicate.

* * * * *